US005421498A

United States Patent [19]

Menoni

[11] Patent Number: 5,421,498

[45] Date of Patent: Jun. 6, 1995

[54] HOLSTER FOR A HAIRDRESSER'S SCISSORS

[76] Inventor: Nancy J. Menoni, 20204 Harmony Rd., Marengo, Ill. 60152

[21] Appl. No.: 216,500

[22] Filed: Mar. 22, 1994

[51] Int. Cl.[6] ..... A45F 3/14

[52] U.S. Cl. ..... 224/220; 224/221

[58] Field of Search ..... 224/220, 219, 221, 222, 224/267, 904, 162

[56] References Cited

U.S. PATENT DOCUMENTS

| | | | |
|---|---|---|---|
| 927,761 | 7/1909 | Zevgschmidt | 224/249 |
| 1,181,646 | 5/1916 | Davis | 224/226 |
| 1,482,647 | 2/1924 | Gise . | |
| 2,728,501 | 12/1955 | Hill | 224/219 |
| 3,627,182 | 12/1971 | Calkins . | |
| 4,186,442 | 2/1980 | Kilgore . | |
| 4,239,136 | 12/1980 | Godwin . | |
| 4,573,267 | 3/1986 | Grohoski et al. . | |
| 4,733,808 | 3/1988 | Turner, Jr. et al. . | |
| 4,826,059 | 5/1989 | Bosch et al. . | |
| 4,938,214 | 7/1990 | Specht et al. . | |
| 4,969,893 | 11/1990 | Swor . | |
| 5,009,347 | 4/1991 | Phelps . | |
| 5,024,361 | 6/1991 | Flowers | 224/904 |
| 5,060,381 | 10/1991 | Taberlet . | |
| 5,064,109 | 11/1991 | Caster . | |
| 5,072,456 | 12/1991 | Elin . | |
| 5,109,608 | 5/1992 | Pracht . | |
| 5,163,206 | 11/1992 | Hernandez | 224/220 |
| 5,221,031 | 6/1993 | Prigmore . | |
| 5,251,378 | 10/1993 | Ayer et al. . | |

FOREIGN PATENT DOCUMENTS

| | | | |
|---|---|---|---|
| 590104 | 6/1925 | France | 224/219 |
| 1208702 | 2/1960 | France | 224/232 |
| 1409131 | 7/1965 | France | 224/232 |
| 1468827 | 2/1967 | France | 224/226 |
| 23529 | 5/1911 | Norway | 224/162 |

*Primary Examiner*—Linda J. Sholl
*Attorney, Agent, or Firm*—Mathew R. P. Perrone, Jr.

[57] ABSTRACT

A holster, which can receive a pair of scissors, holster is secured to the wrist of a person by a pair of straps. One of the straps is wider than the other to provide for a more secure holster position. The scissors are secured to the holster.

18 Claims, 3 Drawing Sheets

FIG. 2
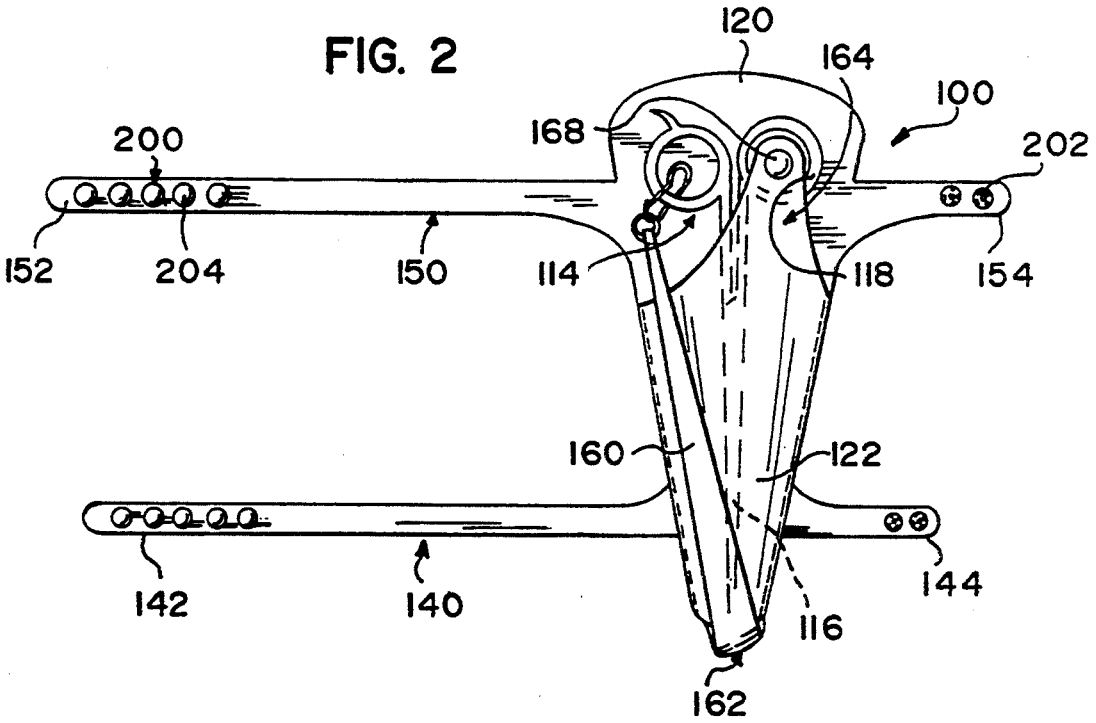
FIG. 1
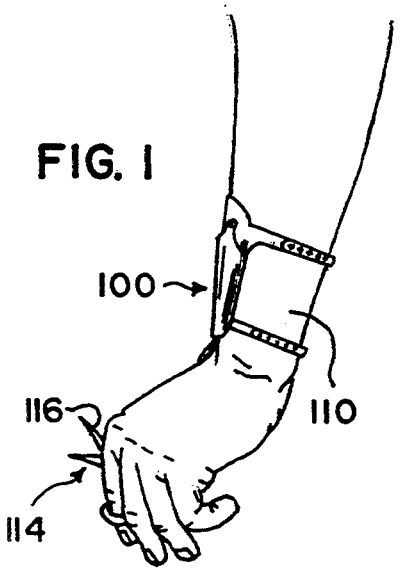
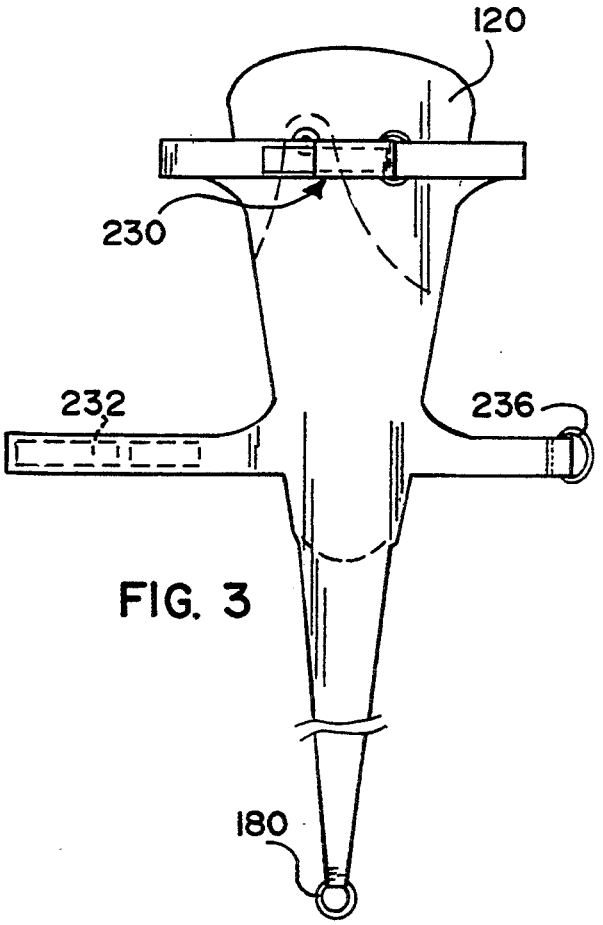
FIG. 3

HOLSTER FOR A HAIRDRESSER'S SCISSORS

This invention relates to a device for positioning scissors, and more particularly to a wrist mounted holster for a hairdresser's scissors.

BACKGROUND OF THE INVENTION

A hairdresser is required to use high quality tools in order to provide consistently good service to a client seeking such services. Especially important to the hairdresser is the quality of the scissors used. These scissors are highly expensive and lack durability if used improperly. The scissors must be available for use and efficiently positioned for such use.

The movement inherently required with scissors in a hairdressing procedure with scissors can lead to the possibility of scissors being dropped. If the scissors are dropped, damage to the scissors can occur. This damage results in replacement of the replacement of a very expensive instrument. It is desirable to keep the instrument handy, yet avoid dropping of the scissors.

Dropped scissors are also out of control. It is clearly desirable to keep scissors in control and avoid the dangers resulting from the lack thereof.

Any device designed to keep the scissors readily available can interfere with the working of the hairdresser. That device may snag a client's hair or interfere with the hairdresser's normal duties. So if the device to keep the scissors handy is to be useful, it must also avoid these problems.

To keep the scissors handy or readily available for use, mitigates against the keeping the scissors in a safe place where they cannot be damaged easily. If the scissors are kept handy in a pocket or other source, access to the scissors in an efficient manner can be denied.

SUMMARY OF THE INVENTION

Among the many objectives of this invention is the provision of holster for scissors to be mounted on a wrist of a person, the scissors being attached to the holster.

A further objective of this invention is to provide a holster to have scissors readily available.

A still further objective of this invention is to provide a holster, which minimizes the dropping of scissors.

Yet a further objective of this invention is to provide a holster, which minimizes the damage to scissors.

Also an objective of this invention is to provide a holster, which minimizes catching of hair.

These and other objectives of the invention (which other objectives become clear by consideration of the specification, claims and drawings as a whole) are met by providing a holster which can receive a pair of scissors. The holster is secured to the wrist of a person. The scissors are secured to the holster.

BRIEF DESCRIPTION OF THE DRAWINGS

FIG. 1 depicts a perspective view of the holster 100 of this invention mounted on the wrist 110 of a person (not shown).

FIG. 2 depicts a top, plan view of the holster 100 of this invention mounted with scissors 114 secured thereto and mounted therein with snap assembly 200.

FIG. 3 depicts a rear, plan view of the holster 100 of this invention with hook and loop assembly 230.

Throughout the figures of the drawings, where the same part appears in more than one figure of the drawings, the same number is applied thereto.

DESCRIPTION OF THE PREFERRED EMBODIMENTS

Figure 4:
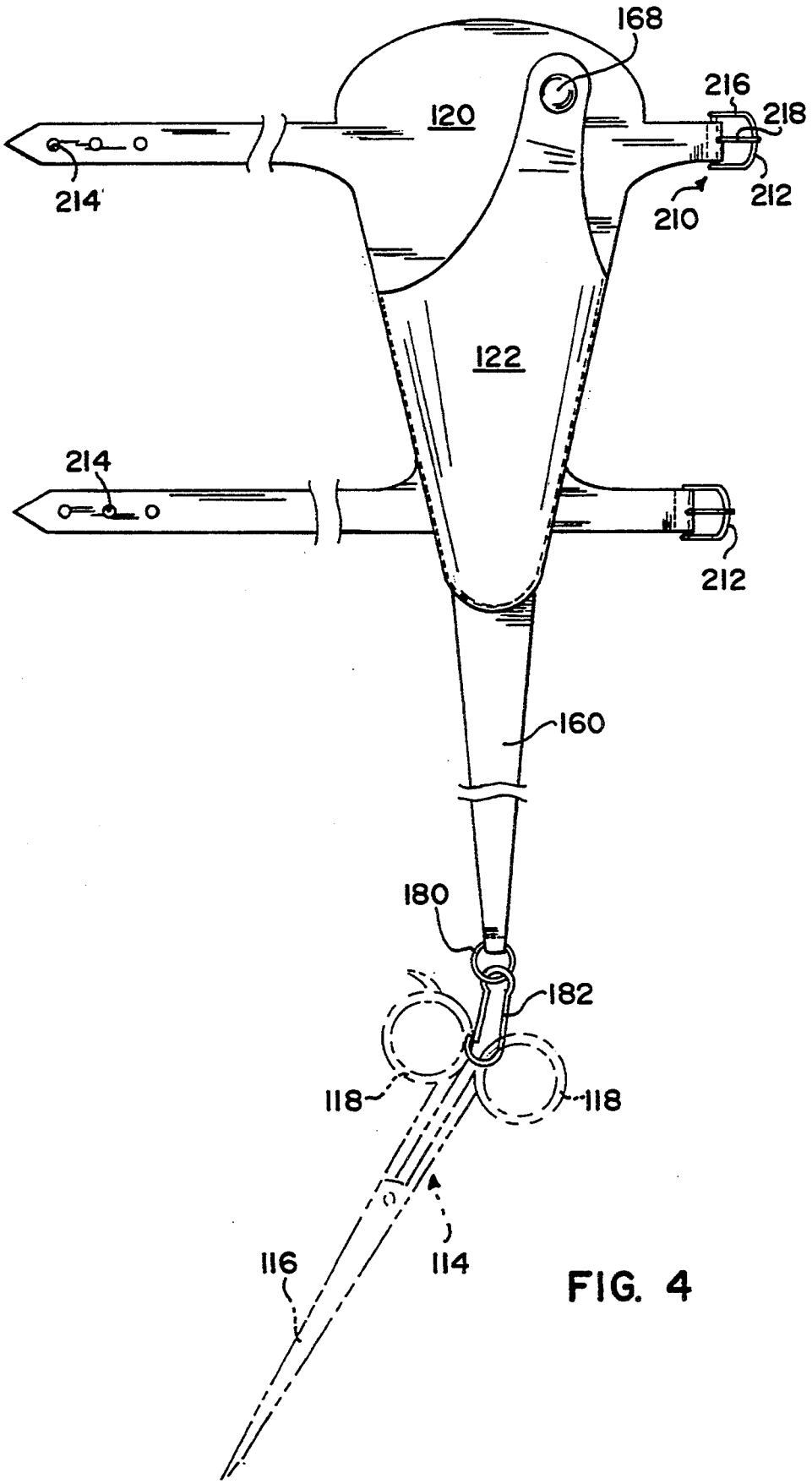
FIG. 4 depicts a top, plan view of the holster 100 of this invention mounted with scissors 116 secured thereto and released therefrom with buckle assembly 210.

A scissors for a hairdresser can be kept handy by use of a wrist holster. This particular wrist holster is secured easily onto the wrist and restrains the scissors. The holster receives the cutting blades of the scissors and keeps the scissors handy for use.

The holster for the scissors is made up of a first piece of material which is resistant to penetration by the scissors. Customarily this material may be leather or another heavy material. The skin piece of the holster covers a substantial portion of the forearm.

The holster is attached to the wrist by the means of one or more straps. The straps may be looped around the wrist and adhered by either a buckle assembly, a hook and loop assembly, a snap assembly, or a combination thereof. Another appropriate assembly may also be used for removably attaching the holster to the wrist.

Especially desired are two wrist straps. The two wrist straps permit more a permanent and secure position of the holster on the wrist. The straps must also be positioned and fastened in a manner to prevent any part of the strap from catching on the hair of the customer, while at the same time providing appropriate positioning for the holster.

A snap assembly is a very convenient fastening or holding mechanism with minimal chance of snagging the client's hair. A snap assembly, however lacks flexibility to adjust to the various sizes for the wrist of a wearer.

With a buckle assembly, the flexibility to adjust to the various sizes for the wrist of a wearer is improved. But the buckle can also be more likely to snag a client's hair.

In a hook and loop assembly, the greatest flexibility to adjust to wrist size is achieved. By providing the loop portion at the end of the strap, the chance of snagging a client's hair is greatly reduced and probably eliminated. The hooks are more likely to snag hair than the loops. Thus the hook and loop assembly, with a stretchable strap is most preferred.

There is a lower strap and an upper strap to hold the holster on the wrist or arm of the hairdresser. The lower strap is adjacent to the part of the holster receiving the cutting blades of the scissors. The upper strap is oppositely disposed from the lower strap and adjacent to the part of the holster supporting the handle of the scissors.

Preferably, the upper strap is about 1.5 to 4.0 centimeters wide. More preferably, the upper strap is about 2.0 to 3.0 centimeters wide. Most preferably, the upper strap is about 2.5 to 2.6 centimeters wide.

Preferably, the lower strap is about 1.0 to 3.0 times as wide as the upper strap. More preferably, the lower strap is about 1.2 to 2.5 times as wide as the upper strap. Most preferably, the lower strap is about 1.4 to 1.8 times as wide as the upper strap. These widths and relationships between the upper strap and the lower strap are the most effective structure for keeping the holster in the desired position. While it is not desired to be bound by any particular theory, the extra width and position of the lower strap provides better flexibility and friction between the skin and strap.

The straps may be made of leather or other suitable material. The strap may be elastic or non elastic. An elastic strap is preferred. Preferably, the straps are made of a slightly stretchable or elastic material to achieve good position holding. Each strap may be permanently or removably secured to the holster. A permanent securing of the strap is preferred.

The upper and lower straps may be replaced by a semi-rigid, but flexible wrist clip or clips if desired. The clips may avoid the strap fasteners. However, these clips lack the flexibility of the straps. Thus a suitable strap fastener is preferred.

A suitable strap fastener for both the upper strap and the lower strap is a snap assembly, a buckle assembly, a hook and loop assembly, another fastening assembly, or combinations thereof. For example a hook and loop system commonly sold under the Trademark VELCRO may be used and is in fact preferred along upper strap and lower strap being slightly elastic.

Also attached to the skin piece of the holster is a handle strip for fitting through the handle of the scissors to hold the scissors in the holster as desired. The handle strip serves as a holster lock to secure the scissors in the holster.

It is also desired to have attached to the holster, a loop or a strip of material. This holster strip has a first end attached to the holster or formed as a part of the holster and, at the same time, has the other end of the holster strip attached to the handle of the scissors. This strip prevents the scissors hitting the floor or other hard object in the event that the scissors are dropped by the hairdresser.

Both the holster strip and the handle strip (holster lock) can be snapped or otherwise secured in place. For example a hook and loop system commonly sold under the Trademark VELCRO may be used.

The holster is customarily worn on the hand used to cut the hair. When the scissors are no longer desired for use, the hairdresser may insert them in the holster with the other hand and strap them into the holster with a locking strap.

Upon a desired use of the scissors, the locking strap is released, the scissors are removed from the holster by the opposing and placed in the cutting hand. Then the scissors are usable. The holding strap still keeps the scissors attached to the holster and avoids the problems caused by dropping the scissors.

The presence of the holster on the wrist keeps the scissors out of the way yet convenient for use. This is very important as the scissors are the most common item used in hairdressing and are required to be kept in a very convenient, but yet safe and handy position.

In FIG. 1, the holster 100 is mounted on the wrist 110 of a person (not shown). A scissors 114 for a hairdresser can be kept handy by use of a holster 100. The holster 100 receives the cutting blades 116 of the scissors 114 and keeps the scissors 114 handy for use as shown in FIG. 2.

The holster 100 includes a skin piece 120, which is adjacent to and may contact the wrist 110 when the holster 100 is worn. Other parts of holster 100 are secured to skin piece 120. A second or holding piece 122 is sewn, glued or otherwise secured to skin piece 120. Scissors 114 are inserted between skin piece 120 and holding piece 122 to be held in holster 100.

Also secured to skin piece 120 are lower strap 140 and upper strap 150, which serve to hold the holster 100 in position on wrist 110 or a forearm. Forearm and wrist 110 can be used interchangeably. Both lower strap 140 and upper strap 150 can be sewn, glued or otherwise secured to holster 100. Preferably both are a part of skin piece 120.

The lower strap 140 is adjacent to the part of the holster 100 receiving the cutting blades 116 of the scissors 114. The upper strap 150 is adjacent to the part of the holster 100 supporting the handle 118 of the scissors 114 and is oppositely disposed from the lower strap 140. Handle 118 for scissors 114 is generally a looped handle.

The lower strap 140 and upper strap 150 may be looped around the wrist 110 and secured thereto and adhered by either a buckle assembly, a hook and loop assembly, a snap assembly, or a combination thereof. Another appropriate assembly may also be used for removably attaching the holster 100 to the wrist 110.

Both lower strap 140 and upper strap 150 may be one or two pieces. Lower strap 140 has two ends extending from holster 100. One end is a lower skin portion 144. The second end is lower top portion 142. Each of lower skin portion 144 and lower top portion 142 contain a joining mechanism which combines to secure lower skin portion 144 to lower top portion 142 around wrist 110. Lower skin portion 144 is generally adjacent to wrist 110 while lower top portion 142 comes over the top thereof and secures thereto.

Similarly to lower strap 140, upper strap 150 has two ends extending from holster 100. One end is a upper skin portion 154. The second end is upper top portion 152. Each of upper skin portion 154 and upper top portion 152 contain a joining mechanism which combines to secure upper skin portion 154 to upper top portion 152 around wrist 110. Upper skin portion 154 is generally adjacent to wrist 110 while upper top portion 152 comes over the top thereof and secures thereto.

The lower strap 140 and upper strap 150 form the two especially desired two wrist straps. Together, they combine to permit more a permanent and secure position of the holster 100 on the wrist 110.

Also on the skin piece 120 of the holster 100 is a handle strip 160 for fitting through the handle 116 of the scissors to hold the scissors 114 attached to the holster 100 as desired. Handle strip 160 is secured to skin piece 120 adjacent to lower strap 140. Preferably, handle strip 160 is secured in a substantially perpendicular position relative to lower strap 140.

Handle strip 160 is a long, flexible strip of material having a sufficient length to permit use of the scissors 114, while the scissors 114 are secured to the holster 100. More particularly, handle strip 160 has a holster end 162 secured to or formed as a part of skin piece 120. Oppositely disposed from holster end 162 is scissors end 164 to be secured to scissors handle 118.

Scissors end 164 may be formed in any suitable fashion. A snap assembly 200 may fit through handle 118 and be looped thereover with the female snap 204 receiving the male snap 202 to hold scissors 114. Scissors end 164 preferably receives a split ring 180 sewn or otherwise secured therein, with a snap clip 182 mounted therein to receive scissors handle 118.

Secondarily attached to the holding piece 122 as an extension thereof and adjacent to upper strap 150 is a holster strip 190 for holding the scissors 114 in the holster 100. After scissors 114 are inserted in the holster 100, holster strip 190 loops over and into handle 118 and is removably secured to skin piece 100 of holster 100, by snap assembly 200 or other suitable device.

A standard snap assembly 200, as shown in FIG. 2 is a very convenient holding mechanism with minimal chance of snagging the client's hair. The snap assembly 200 includes a male snap portion 202 generally secured to a lower skin portion 144 of lower strap 140 and upper skin portion 154 of upper strap 150 so that male snap portion 202 is adjacent to the wrist 110.

This male snap portion 202 is generally on lower skin portion 144 or upper skin portion 154. The female snap portion 204 on upper top portion 152 or lower top portion 142 joins thereto and holds holster 100 in the desired position.

With a buckle assembly 210 of FIG. 4, the flexibility to adjust to the various sizes for the wrist 110 of a wearer is met by providing a buckle 212 on one of either upper skin portion 154 or lower skin portion 144. The apertured end, with aperures 214 being either upper top portion 152 or lower top portion 142, passes through buckle frame 216 and one of apertures 214 receives buckle arm 218.

Figure 5:
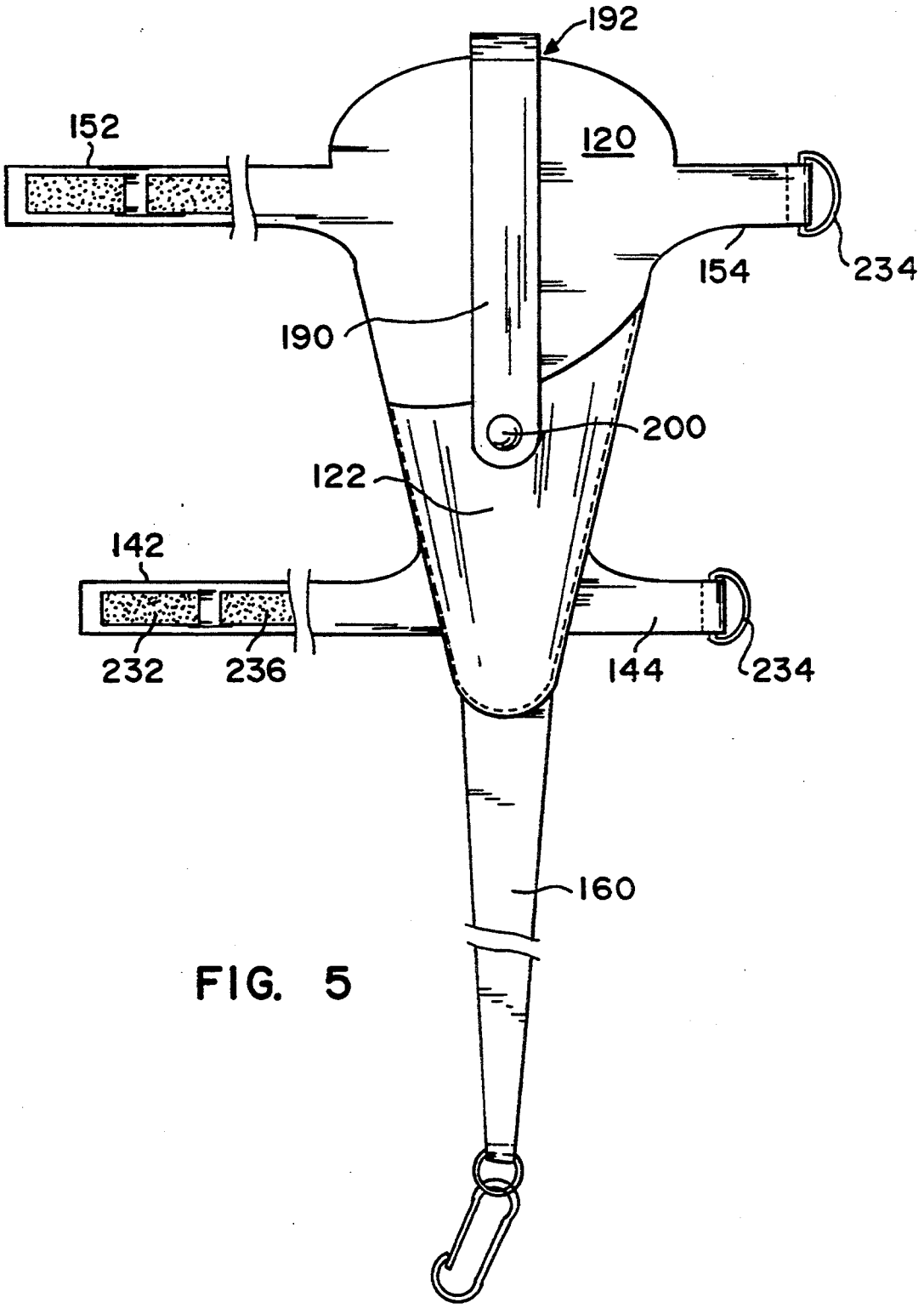
FIG. 5 depicts a rear, plan view of the holster 100 of this invention with a second embodiment of hook and loop assembly 230.

In a hook and loop assembly 230 shown in FIG. 3 and FIG. 5, the greatest flexibility to adjust to the size of wrist 110 achieved. Lower skin portion 144 and upper skin portion 154 preferably contain the hook portion 236. Lower top portion 147 and upper top portion 152 contain the loop portion 232, which combines to secure lower skin portion 144 to lower top portion 142 around wrist 110. Upper strap 150 is secured around wrist 110 in the same fashion. By providing the loop portion 232 and the hook portion 236 as indicated the chance of snagging a client's hair is greatly reduced and probably eliminated. Thus the hook and loop assembly 230, with a stretchable strap is most preferred.

In the hook and loop assembly 230 shown in FIG. 5, the greatest flexibility to adjust to wrist size is achieved. By providing the loop portion 232 at the end of either skin portion 144 or 154 and the hook portion 236 adjacent thereto, and a rigid frame 234 in the end of lower top portion 142 and upper top portion 152, as loop portion 232 passes through rigid frame 234, it may double back and join hook portion 236. The chance of snagging a client's hair is greatly reduced and probably eliminated. Thus the hook and loop assembly 230, with a stretchable strap is most preferred.

As shown in FIG. 5, holster strip 190 may alternatively include a sewn portion 192 to secure one end thereon, with a snap assembly like snap assembly 200 to secure the other end to either skin piece 120 or holding piece 122. In this fashion, scissors 114 are secured in holster 100. Other securing assemblies may also be operable. In this way, the scissors 114 do not fall out of holster 100.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A holster for holding a hairdresser's scissors, the holster being securable to a forearm of a person, comprising:

a) a first piece of material being positionable adjacent the skin of a wearer when worn;

b) a second piece of material being secured to the first piece of material;

c) a first securing means for securing the second piece of material to the first piece of material to form a closed end of the holster and an open end of the holster oppositely disposed from the closed end;

d) the second piece of material having an opening at the open end between the first piece of material and the second piece of material at one end thereof to permit scissors to be inserted between the first piece of material and the second piece of material;

e) a first strap adjacent to the closed end of the holster with forearm securing means for attaching the first strap around the user's forearm;

f) a second strap adjacent the open end of the holster with forearm securing means for attaching the second strap around the user's forearm;

g) said first strap being wider than the second strap;

h) a scissors strip being secured to the holster adjacent the closed end and of sufficient length to be attached to the scissors and to permit the scissors to be held in the user's hand and to be inserted into the holster as desired when attached to the scissors strip;

i) a handle strip being oppositely disposed from the scissors strip and secured to the holster to hold the scissors in the holster;

j) the scissors strip including a first holster end adjacent to the closed end of the holster;

k) the scissors strip including a second scissors end oppositely disposed from the first holster end; and l) the second scissors end including a second securing means for holding the scissors to the scissors strip.

2. The holster of claim 1 wherein further comprising the first strap being 1.2 to 2 times as wide as the second strap.

3. The holster of claim 1 further comprising the forearm securing means being a buckle assembly.

4. The holster of claim 1 further comprising the forearm securing means being a snap assembly.

5. The holster of claim 1 further comprising the forearm securing means being a hook and loop assembly.

6. The holster of claim 5 further comprising:

a) the hook and loop assembly having a hook assembly on a hook strap adjacent the skin of the wearer;

b) the hook assembly being on the hook strap oppositely disposed from the skin of the wearer;

c) the hook and loop assembly having a loop assembly on a loop strap; and d) the hook strap and the loop strap being capable of joining together to hold the holster on the wrist of the wearer.

7. The holster of claim 5 further comprising:

a) the hook and loop assembly further including a ring to receive the strap therethrough;

b) the loop assembly being at the end of the strap;

c) the hook assembly being adjacent thereto; and d) the loop assembly fitting through the ring and being folded back over the hook assembly.

8. The holster of claim 1 further comprising the handle strip being a part of the second piece of material and securable to the first piece of material.

9. The holster of claim 1 further comprising the handle strip being part of the first piece of material and securable to the second piece of material.

10. A holster for holding a hairdresser's scissors comprising:

a) a first piece of material being a base for having secured thereto at least one other part of the holster;

b) a second piece of material being secured to the first piece of material;

c) a first securing means for securing the second piece of material to the first piece of material to form a closed end of the holster and an open end of the holster oppositely disposed form the closed end;

d) the second piece of material having an opening at the open end between the first piece of material and the second piece of material at one end thereof to permit scissors to be inserted between the first piece and the second piece of material;

e) a first strap adjacent to the closed end of the holster with forearm securing means for attaching the first strap around the user's forearm;

f) a second strap adjacent to the open end of the holster with forearm securing means for attaching the second strap around the user's forearm;

g) a scissors strip being secured adjacent to the closed end and being of sufficient length to be attached to the scissors and to permit the scissors to be held in the user's hand and to be inserted into the holster as desired when attached to the scissors strip;

h) a handle strip being secured to the holster to hold the scissors in the holster;

i) the scissors strip including a first holster end and a second scissors end oppositely disposed from the first holster end;

j) the first holster end being secured to the holster; and k) the second scissors end including a second securing means for holding the scissors to the scissors strip.

11. The holster of claim 10 further comprising the first strap being 1.2 to 2 times as wide as the second strap.

12. The holster of claim 10 further comprising the forearm securing means being a buckle assembly.

13. The holster of claim 10 further comprising the forearm securing means for first strap and the second strap being a snap assembly.

14. The holster of claim 10 further comprising the forearm securing means for first strap and the second strap being a hook and loop assembly.

15. The holster of claim 14 further comprising:

a) the hook and loop assembly having a hook assembly on a hook strap adjacent the skin of the wearer;

b) the hook assembly being on the hook strap oppositely disposed from the skin of the wearer;

c) the hook and loop assembly having a loop assembly on a loop strap; and d) the hook strap and the loop strap being capable of joining together to hold the holster on the wrist of the wearer.

16. The holster of claim 14 further comprising:

a) the hook and loop assembly further including a ring to receive the strap therethrough;

b) the loop assembly being at the end of the strap;

c) the hook assembly being adjacent thereto; and d) the loop assembly fitting through the ring and being folded back over the hook assembly.

17. The holster of claim 10 further comprising the handle strip being a part of the second piece of material and securable to the first piece of material.

18. The holster of claim 10 further comprising the handle strip being part of the first piece of material and securable to the second piece of material.

* * * * *